US006185846B1

(12) United States Patent
Neidhardt, Jr.

(10) Patent No.: US 6,185,846 B1
(45) **Date of Patent: *Feb. 13, 2001**

(54) MANEUVERABLE SNOWSHOE

(75) Inventor: George M. Neidhardt, Jr., Pleasant Grove, CA (US)

(73) Assignee: Pride Industries, Roseville, CA (US)

( * ) Notice: Under 35 U.S.C. 154(b), the term of this patent shall be extended for 0 days.

This patent is subject to a terminal disclaimer.

(21) Appl. No.: 09/448,273

(22) Filed: Nov. 24, 1999

Related U.S. Application Data

(63) Continuation-in-part of application No. 09/201,340, filed on Nov. 30, 1980, now Pat. No. 6,092,312.

(51) Int. Cl.[7] ..... A43B 5/04

(52) U.S. Cl. ..... 36/124; 36/122

(58) Field of Search ..... 36/122–125

(56) References Cited

U.S. PATENT DOCUMENTS 5,517,772 * 5/1996 Anderson .
5,540,002 * 7/1996 Liautaud .
5,659,981 * 8/1997 Liautaud .
5,787,612 * 8/1998 Mahoney et al. .
5,809,668 * 9/1998 Kiniry et al. .
5,887,362 * 3/1999 McKenzie .
5,996,259 * 12/1999 Galley et al. .
6,092,312 * 7/2000 Neidhardt .

OTHER PUBLICATIONS

P. 106 and another (unnumbered) page of a German language publication from an Austrian retailer "Transa" that appears to be part of a catalogue.

* cited by examiner

*Primary Examiner*—Ted Kavanaugh
(74) *Attorney, Agent, or Firm*—C. Michael Zimmerman

(57) ABSTRACT

A snowshoe is described in which both a simple toe strap and a simple ankle strap are connected to a single, large claw plate, wherein the heel of the user's foot is maintained on an upper surface of the decking.

14 Claims, 3 Drawing Sheets

MANEUVERABLE SNOWSHOE

CROSS-REFERENCE TO RELATED APPLICATION

This application is a continuation-in-part of earlier patent application Ser. No. 09/201,340 filed Nov. 30, 1980 and entitled STABLE, LIGHTWEIGHT SNOWSHOE.

DISCLOSURE

BACKGROUND OF THE INVENTION

This present invention relates to a snowshoe construction and, more particularly, to a lightweight snowshoe providing a user with enhanced maneuverability.

Because in the past snowshoes have been awkward to use, many design changes to the basic construction have been proposed. Much of the recent effort has been devoted to designing binding arrangements and their securance to the remainder of the snowshoe in such a way as to accommodate the natural stride of an individual, such as by allowing the foot to cant behind the user without the snowshoe itself leaving the ground. In other words, many relatively modern snowshoe designs include an articulating hinge rod or the like to allow the toe of a user to grip the snow (typically with the aid of a crampon) while the heel lifts up from the snowshoe. Examples of this type of shoe construction can be found in U.S. Pat. Nos. 3,517,772 and 5,787,612.

This approach, as well as other approaches, have not resulted in a snowshoe which is commercially acceptable for certain uses.

SUMMARY OF THE INVENTION

The present invention provides a lightweight snowshoe construction which assures that the user remains highly maneuverable. The snowshoe is designed so that the wearer hardly knows he/she has snowshoes on.

More specifically the shoe is designed to impart basically all of the weight on a user's leg to a single claw plate in all situations. To this end, the foot binding arrangement (preferably simply a plurality of straps as will be described) is rigidly connected to the claw plate at a pair of locations which are spaced longitudinally of the foot of a user to accept the weight of the user transmitted through the foot both at the ball and heel of the foot. This is simply accomplished by providing one of the locations near the ball of the foot and the other at the rear portion of the instep, i.e., adjacent to the user's ankle. Thus the claw plate provides a very stable platform for the user. The maneuverable showshoe of the invention includes both a peripheral frame and a membrane which is circumscribed by the same. The upper surface of the membrane is provided with the foot binding arrangement whereas the underneath or bottom surface of such membrane has the claw plate.

Most desirably, the claw plate extends to the peripheral frame of the shoe, both at the toe securance location and the ankle securance location. The result is that the claw plate acts not only to grip snow, but also to reinforce the snowshoe laterally. This enables the peripheral frame to be provided by a relatively flexible and lightweight tubular material. As a major feature of the instant invention reinforcing strapping extends from the foot binding arrangement to the peripheral frame to transfer to such frame, all forces which might tend to distort the membrane, including all torsional forces and all forces (including components of forces) which lie in the plane of the membrane.

Other features and advantages of the invention either will become apparent or will be described in connection with the following, more detailed description of a preferred embodiment of the invention and variations.

BRIEF DESCRIPTION OF THE DRAWINGS

With reference to the accompanying sheets of drawings.

DETAILED DESCRIPTION OF A PREFERRED EMBODIMENT

Figure 1:
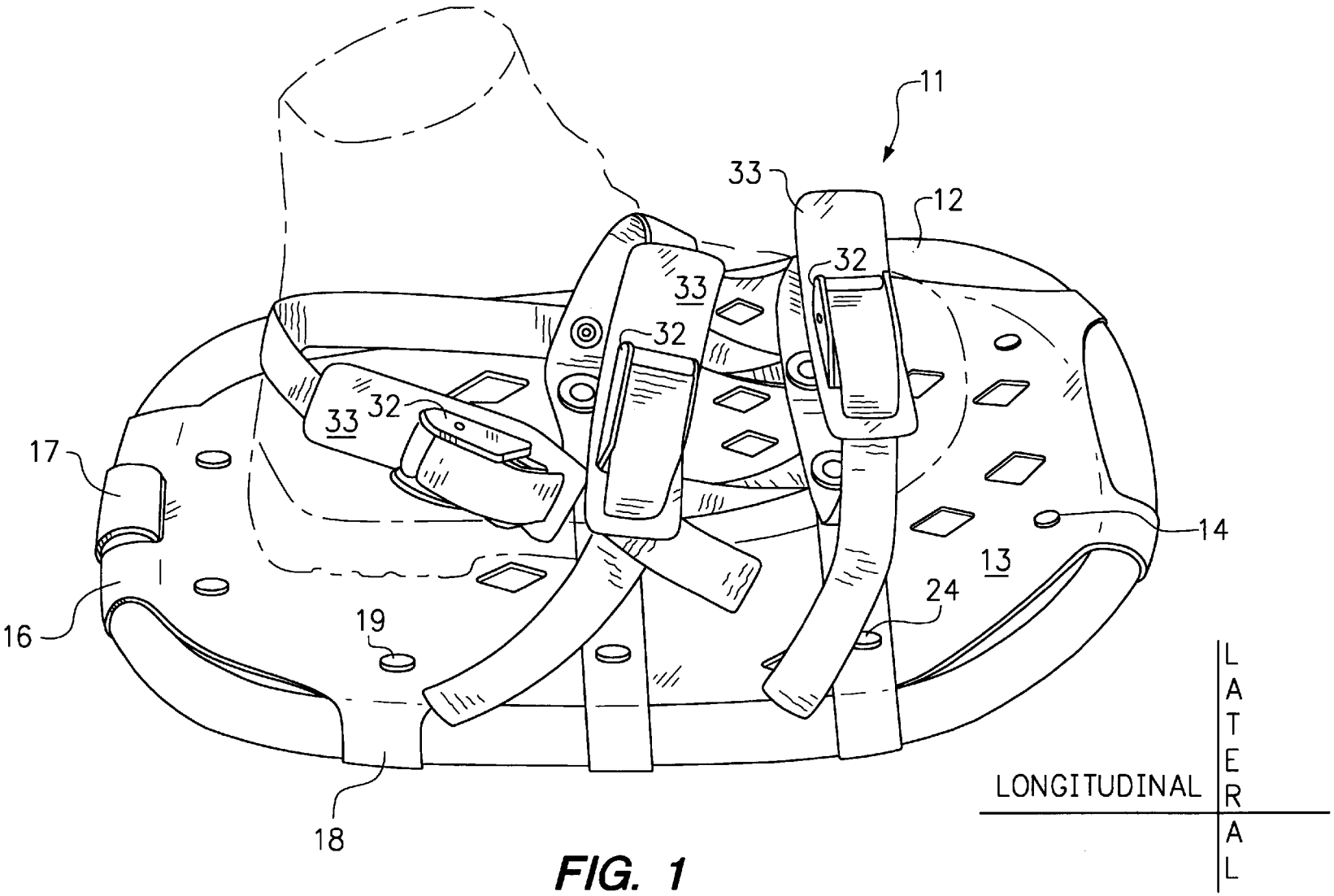
FIG. 1 is an isometric view of a preferred embodiment of the snowshoe construction of the invention, showing a user's foot in dotted lines.

The following, relatively detailed description is provided to satisfy the patent statutes. It will be appreciated by those skilled in the art, though, that various changes and modifications can be made without departing from the invention.

A preferred embodiment of the snowshoe of the invention is generally referred to in the figures by the reference numeral 11. The configuration provided by the snowshoe construction is generally conventional in that it includes a peripheral frame 12 and a membrane decking 13. As is illustrated, the decking 13 extends between the sides of the frame as well as to its front designated by 14 and to its rear designated by 16. In this connection, the frame is a closed loop and its rear is provided by an end coupling 17 which secures together two ends of tubing. The membrane decking can be made of any relatively flexible material typically used for such a purpose. In one implementation the membrane decking was 50 thousandths ($^{50}/_{1000}$) extruded thermoplastic sheet. Membrane decking 13 is secured at various locations to the peripheral frame as shown by tab extensions 18 of the same wrapping around the peripheral frame and being secured in position by rivet/washer combinations 19. Apertures 20 are provided extending through the membrane decking to facilitate the passage of snow.

Figure 3:
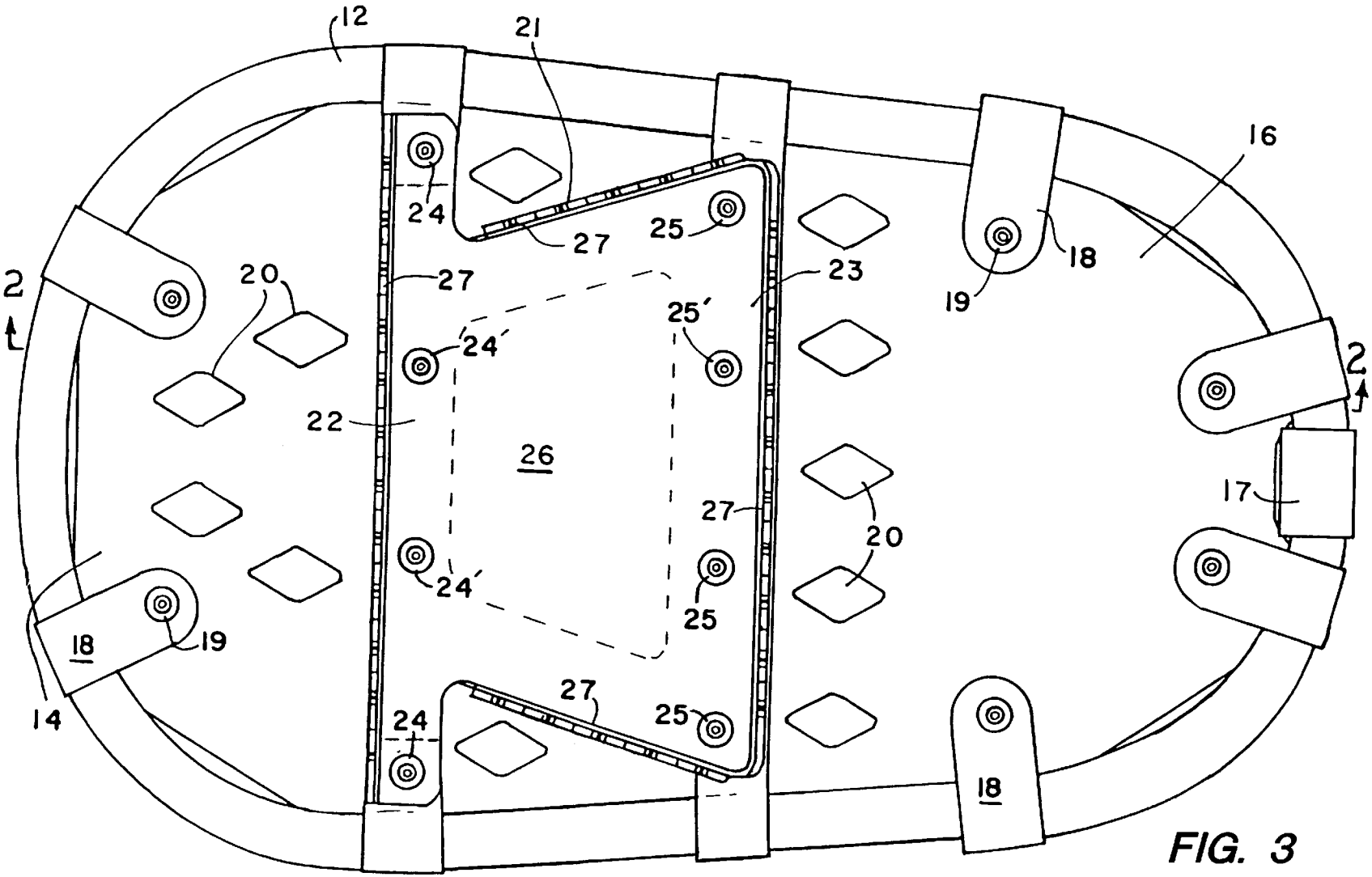
FIG. 3 is a plan view of the underneath side of the preferred embodiment of the snowshoe construction of the invention.

The snowshoe includes a large claw plate 21 which is secured adjacent its forward edge 22 and its rear edge 23 on the underneath surface of the membrane decking, respectively, by laterally extending rows of rivet/washer combinations 24, 24' and 25, 25'. As will become apparent hereinafter, the pattern and function of such rivet/washer combinations is quite important to the invention. Suffice it to say now that as illustrated in FIG. 3, the claw plate extends to the adjacent frame at both its forward and rear edges 22 and 23. The claw plate 21 itself is made of a relatively rigid material, such as aluminum, and is cut out at its center to reduce weight. A covering piece of membrane decking material 26 is provided, covering all of the underneath surface of the claw plate not having teeth to thereby inhibit the build-up of snow at the plate.

Since the claw plate extends to adjacent the frame, it adds strength co the snowshoe construction by allowing the frame to be made of material which otherwise would allow the frame to flex inward. In one implementation the frame was provided by schedule 40, PVC tubing having a wall thickness of 0.12 inches, whereas the material of the claw plate was 0.125 inch thick aluminum.

The periphery of claw plate 21 is provided with projections that define teeth 27. That is, the front 22 of the claw plate includes 12 teeth in the embodiment illustrated whereas the rear 23 of the claw plate includes 10 teeth. The side edges each have five teeth 27 as shown.

A binding arrangement for the foot of a user (which foot typically will be encased within a boot) is also provided. Such binding arrangement is relatively simple as is desirable to enable a user to quickly don or remove a snowshoe incorporating the construction of the invention. In this connection, it includes three straps, a toe strap 29, an ankle strap 30 (which strap in many arrangements is referred to as an upper instep strap) and a heel strap 31. As is common, each of the straps is actually two straps which are connected together. With this arrangement such straps are connected together by spring cam buckles 32, such as those available from Kinedyne of Rancho Cucamonga, Calif., which facilitate strap length adjustment. As is shown in FIG. 1, each cam buckle also is provided with a shield 33, which shield as is standard includes a slot for threading of a loose strap end.

Figure 2:
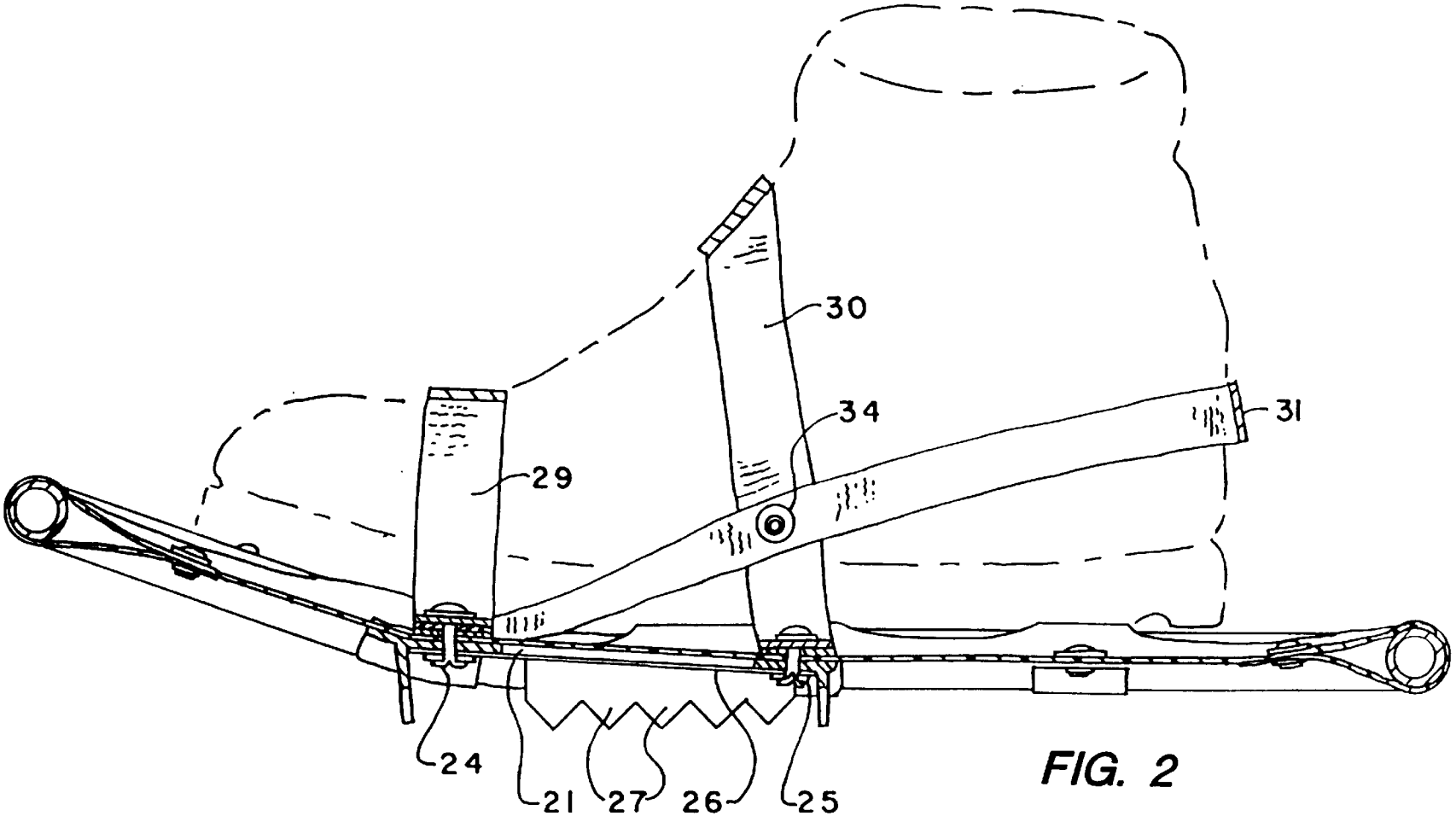
FIG. 2 is a longitudinal sectional view of the preferred embodiment of FIG. 1.

The foot binding arrangement is secured to the claw plate 21 directly both at the ball of a user's foot and at a position which is spaced rearwardly thereof a sufficient distance to also maintain the heel of a user's foot at the upper surface of the snowshoe, whereby substantially all of the weight on the leg terminating in the bound foot is supported by the claw plate. That is, the center two rivets 24' are secured through the membrane decking 14 directly to the toe strap 29 as is best illustrated in FIG. 2. The ends of the heel strap 31 are also secured to the claw plate via the rivets 24'. The foot binding arrangement is also secured to the claw plate at the ankle or upper instep strap 30. It is so secured with and through the decking to the claw plate by the rivet/washer combinations 25'.

The toe strap maintains the toes and ball of the foot of a user in position, whereas the ankle or instep strap 30 maintains the heel in contact with or in close proximity to the snowshoe construction. In this connection, a rivet/washer combination 34 (FIG. 2) connects the ankle strap 30 to the heel strap 31 and thus such ankle strap is maintained in proper angular position. (It will be recognized that although not shown the side opposite that shown will be a mirror image, i.e., the ankle strap 30 is connected to the heel strap 31 at the same location via a rivet/washer combination.) The binding arrangement and its securance to the claw plate through the decking acts to transfer the weight of a user (when the user is in a typical position) to the claw plate 21.

While the weight of a user is transferred by the binding arrangement to the claw plate, the membrane decking is between the same. As a major feature of the invention, reinforcing strapping in the form of a pair of reinforcement straps 29 and 30 extend from the foot binding arrangement to the opposed sides of the peripheral frame to transfer to the peripheral frame those distortion forces which otherwise might result in distortion of the membrane, FIG. 1 shows straps 29 and 30 on the side of the foot binding which is visible, it being recognized that such straps extend to the opposite side of the frame which is hidden from view. As can be seen from FIG. 3, the straps 29 and 30 wrap around the frames and are secured in position by the same rivet/washer combinations 24 and 25, respectively, that secure the claw plate adjacent the frame at its forward and rear edges.

The bindings are secured at each of the two longitudinally spaced locations by laterally spaced rivet/washer combinations 24' and 25'. These laterally spaced rivet/washer combinations are symmetric about the center line of the snowshoe construction and are positioned to be inwardly adjacent the edges of the foot of a wearer on the upper side of the snowshoe construction. It is to be noted that the decking is sandwiched between the foot binding arrangement and the claw and thus is also secured both to the binding and to the claw plate at the securance locations.

The longitudinally spaced pair of direct securance locations between the foot binding arrangement and the single claw plate is a major factor in the stability provided by the construction of the instant invention. A snowshoe incorporating the invention acts, in essence, simply as an extension of a user's foot. (In this connection, the snowshoe is relatively short as is illustrated in FIG. 1—in one implementation it is only 18.5 inches long.) The snowshoe moves with the foot. Its forward end is bent upwardly through a slight angle as is illustrated in FIG. 2 to facilitate forward movement. The securance of the claw plate at both its forward end and rear end by laterally spaced rivet/washer combinations adds to this stability, as does the fact that the claw plate extends laterally beyond the edges of the foot of a user.

As mentioned at the beginning of the detailed description, applicant is not limited to the specific embodiment and variations described above. They are exemplary, rather than exhaustive. The claims, their equivalents and their equivalent language define the scope of protection,

What is claimed is:

1. A maneuverable snowshoe comprising:

A. a peripheral frame having opposite sides, a front and a rear;

B. a membrane decking interiorly of said frame, defining upper and underneath surfaces for said snowshoe;

C. a foot binding arrangement on said upper surface for holding a user's foot in position with the toes of the foot facing toward said front;

D. a claw plate on the underneath surface of said snowshoe construction secured rigidly to said foot binding arrangement both at a first location positioned to bind the ball of a user's foot to said upper surface and at a second location spaced longitudinally rearwardly of said first location a sufficient distance to also maintain the heel of a user's foot at the upper surface of said snowshoe, whereby substantially all of the user's weight on the leg terminating in said foot is supported by said single claw plate; and E. A structure strapping extending from said foot binding arrangement to said peripheral frame to transmit a portion of the loading provided by a user's foot to said peripheral frame.

2. The maneuverable snowshoe of claim 1 wherein said claw plate extends laterally on said underneath surface beyond said foot binding arrangement.

3. The maneuverable snowshoe of claim 2 wherein said claw plate extends laterally to adjacent opposite sides of said peripheral frame to provide lateral support for said snowshoe.

4. The maneuverable snowshoe of claim 3 wherein said claw plate extends laterally to adjacent said opposite sides laterally at both said first and second locations at which said foot binding arrangement is rigidly secured to said snowshoe.

5. The maneuverable snowshoe of claim 1 wherein said membrane decking is also connected both to said binding and to said claw plate.

6. The maneuverable snowshoe of claim 5 wherein said claw plate, and said binding arrangement are connected at two laterally spaced positions at both said first and second locations.

7. The maneuverable snowshoe of claim 6 wherein said two laterally spaced positions are adjacent the positions at which side edges of a user's foot are to be held.

8. The maneuverable showshoe of claim 1 wherein both said structural strapping and said claw plate extend laterally to adjacent opposite sides of said peripheral frame from both said first and second locations.

9. The maneuverable snowshoe of claim 1 wherein said foot binding arrangement is provided by straps and cam buckles.

10. The maneuverable snowshoe of claim 1 wherein said second location is adjacent the ankle of a user's foot.

11. The maneuverable snowshoe of claim 10 wherein said foot binding arrangement is made up of three straps, one positioned to grip the toe of the user, a second one positioned to grip the foot of a user adjacent such user's ankle, and a third one positioned to encircle a user's foot at the heel thereof.

12. The maneuverable snowshoe of claim 11 wherein said second location is at the location at which said second strap is secured.

13. The maneuverable snowshoe comprising:

A. a peripheral frame having opposite sides, a front and a rear;

B. a membrane decking extending between said opposite sides, front and rear of said frame, said decking defining upper and underneath surfaces for said snowshoe construction;

C. a foot binding arrangement on said upper surface for holding a user's foot in position with the toes of the foot facing toward said front, said foot binding arrangement being made up of three straps and associated cam buckles, a first one of said straps being a toe strap positioned to bind the toes and ball of a user's foot, a second one of said straps being an ankle strap positioned to bind the user's foot adjacent an ankle, and a third one of said straps being a heel strap designed to encircle the heel of a user's foot;

D. a claw plate on the underneath surface of said snowshoe construction secured rigidly to said foot binding arrangement both at two laterally spaced positions at said toe strap and at two laterally spaced positions at said ankle strap, whereby substantially all of the user's weight on the leg terminating in said foot s supported by said single claw plate; and E. Structural strapping extending between said foot binding arrangement and said peripheral frame to transmit torsional loading provided by a user's foot to said frame.

14. The maneuverable snowshoe of claim 13 wherein said claw plate extends laterally to adjacent opposite sides of said peripheral frame to provide lateral support for said construction.

* * * * *